US012735794B2

(12) United States Patent
Liu et al.

(10) Patent No.: US 12,735,794 B2
(45) Date of Patent: Sep. 15, 2026

(54) BIOMIMETIC ELECTRODE AND MEMBRANELESS WATER ELECTROLYSIS REACTOR BASED ON ROSE PETAL EFFECT

(71) Applicant: Nanjing University of Science and Technology, Nanjing City (CN)

(72) Inventors: Dong Liu, Nanjing City (CN); Kai Deng, Nanjing City (CN); Hao Feng, Nanjing City (CN); Ying Zhang, Nanjing City (CN); Qiang Li, Nanjing City (CN)

( * ) Notice: Subject to any disclaimer, the term of this patent is extended or adjusted under 35 U.S.C. 154(b) by 546 days.

(21) Appl. No.: 18/494,215

(22) Filed: Oct. 25, 2023

(65) Prior Publication Data

US 2024/0410065 A1 Dec. 12, 2024

(30) Foreign Application Priority Data

Jun. 9, 2023 (CN) ..... 202310683678.3

(51) Int. Cl.
*C25B 11/02* (2021.01)
*C25B 1/04* (2021.01)

(52) U.S. Cl.
CPC ..... *C25B 11/02* (2013.01); *C25B 1/04* (2013.01)

(58) Field of Classification Search
None
See application file for complete search history.

(56) References Cited

U.S. PATENT DOCUMENTS

2014/0377647 A1* 12/2014 Nakanishi ..... H01M 4/366
429/213

OTHER PUBLICATIONS

Cui et al ("Two-Dimensional Porous SiO2 Nanostructures Derived from Renewable Petal Cells with Enhanced Adsorption Efficiency for Removal of Hazardous Dye", ACS Sustainable Chemistry & Engineering, vol. 5, Issue 4, 2017, pp. 3478-3487). (Year: 2017).*

* cited by examiner

*Primary Examiner* — Alexander W Keeling

(57) ABSTRACT

The present invention discloses a rose petal effect-based biomimetic electrode and a membrane-less water electrolysis reactor utilizing the same, belongs to the technical field of catalytic technology for water electrolysis. The electrode has a surface exhibiting a microscopically alternating hydrophilic-hydrophobic periodic structure. The hydrophilic parts ensure good contact between the catalyst and the electrolyte solution, thereby guaranteeing the electrode's catalytic performance. The hydrophobic parts allow the gas generated at the electrode surface to be discharged through internal porous channels, preventing the formation of visible bubbles on the electrode surface and thereby fundamentally avoiding issues caused by bubble formation. The membrane-less water electrolysis reactor utilizing the electrode can eliminate bubble formation on the electrode surface, thereby avoiding problems related to bubble covering catalytic sites, bubble resistance, and gas mixing. Additionally, it reduces electrolyte resistance loss, making the performance of the membrane-less water electrolysis reactor approach that of membrane electrode reactors.

12 Claims, 6 Drawing Sheets

BIOMIMETIC ELECTRODE AND MEMBRANELESS WATER ELECTROLYSIS REACTOR BASED ON ROSE PETAL EFFECT

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

CROSS-REFERENCE TO RELATED APPLICATIONS

The present application claims priority from the Chinese Invention patent application No. 2023106836783 filed on 9 Jun. 2023, and the disclosure of which is incorporated herein by reference in its entirety.

FIELD OF THE INVENTION

The invention belongs to the technical field of catalytic technology for water electrolysis, and in particular relates to a rose petal effect-based biomimetic electrode and a membrane-less water electrolysis reactor.

BACKGROUND OF THE INVENTION

Compared with the traditional use of coal or natural gas to obtain hydrogen, hydrogen production by electrolysis of water is a clean hydrogen production technology. Electrolyzed water uses electric energy to generate oxygen by oxidation reaction at the anode and hydrogen gas by reduction reaction at the cathode. Currently, there are mainly three technical solutions for electrolyzing water to produce hydrogen: alkaline electrolytic cell, proton exchange membrane electrolytic cell and membrane-less electrolytic cell.

An alkaline electrolytic cell is composed of a cathode, an anode, and a porous membrane. The electrolyte is generally a 25%-30% potassium hydroxide solution. During the electrolysis of water, a large number of hydrogen bubbles and oxygen bubbles are produced at the cathode and anode, respectively, leading to the following issues:

1) The catalytic surfaces of the electrodes are covered by bubbles, preventing contact between the electrolyte and the catalytic surfaces, resulting in a decrease in electrode performance. 2) The electrolyte contains a large number of bubbles, hindering ion transport and introducing bubble internal resistance, thereby increasing energy loss. 3) Bubbles pass through the porous membrane, causing mixing of hydrogen and oxygen gases, which poses safety concerns.

Due to the aforementioned issues, operating current density range of alkaline electrolytic cells are generally limited to 0.2 to 0.4 A $cm^{-2}$, which can only achieve an energy efficiency of less than 60%.

Proton exchange membrane electrolysis cells are composed of a cathode, an anode, and a proton exchange membrane. The cathode, anode, and proton exchange membrane are thermally pressed together to form the membrane electrode assembly. The proton exchange membrane conducts protons and prevents gas mixing, enabling high-current, high-efficiency hydrogen production, but has the following main issues:

1) Proton exchange membrane components are expensive, increasing hydrogen production costs. 2) Maintenance of the membrane electrode assembly is inconvenient, and its lifespan is relatively short. 3) It can only operate under acidic conditions.

As the hydrogen production cost based on proton exchange membrane electrolysis cells remains high, it does not hold an advantage compared to traditional hydrogen production from fossil fuels.

For cost reduction, membrane-less electrolysis cells are developed to consist of cathode and anode only, eliminating the need for a separator or proton exchange membrane. However, existing membrane-less electrolysis cells have the following issues:

1) The catalytic surfaces of the electrodes are covered by bubbles, preventing contact between the electrolyte and the catalytic surfaces, resulting in a decrease in electrode performance. 2) The electrolyte contains a large number of bubbles, hindering ion transport and introducing bubble internal resistance, thereby increasing energy loss. 3) Without a physical barrier between the cathode and anode, gases can easily mix, leading to safety concerns.

In other words, the existing membrane-less reactors cannot simultaneously meet the requirements for high current density, high hydrogen purity, and high energy conversion efficiency. They can only be applied in scenarios with low current density and low hydrogen purity requirements.

The catalytic activity may be affected by hydrophilicity and hydrophobicity of electrodes. Within hydrophobic porous electrodes, there exist hydrophobic gas channels through which the gases generated by the electrode reactions can be released, preventing the bubbles from diffusing into the electrolyte. However, because the hydrophobic electrode cannot be adequately wetted by the electrolyte solution, the contact between the catalyst and reactants is insufficient, leading to a decrease in electrode catalytic performance.

Hydrophilic electrodes are thoroughly wetted by the electrolyte solution, resulting in better electrode catalytic performance. However, due to the absence of hydrophobic gas channels, the gases produced at the electrode surface can only be released into the electrolyte solution in the form of bubbles. This leads to problems like bubble internal resistance and mixing of products, particularly including:

1) Issue of catalytic sites being covered by bubbles: for alkaline electrolytic cells and traditional membrane-less electrolysis cells, bubbles generated at the electrode surface can cover active catalytic sites, causing a deterioration of electrode performance.

2) Bubble internal resistance issue: for alkaline electrolytic cells and traditional membrane-less electrolysis cells, the electrodes release a large number of bubbles into the electrolyte. These bubbles hinder ion transport, introducing additional bubble resistance (internal resistance), thereby increasing the system's energy loss.

3) Gas mixing issue: in traditional reactors, bubbles generated at the electrode surface can easily lead to gas mixing.

4) Electrolyte resistance issue: in traditional membrane-less reactors designed to prevent bubble mixing, the cathode-anode distance is often increased to lower the probability of bubble mixing. However, such design may lead to increased electrolyte resistance.

SUMMARY OF THE INVENTION

The purpose of this section is to provide an overview of certain aspects of the embodiments of the present invention and to briefly introduce some preferred embodiments. In this section, as well as in the abstract of the specification and the title of the invention, simplifications or omissions may be made to avoid obscuring the purposes of this section, the abstract of the specification, and the title of the invention. Such simplifications or omissions are not intended to limit the scope of the present invention.

According to one aspect of the present invention, a rose petal effect-based biomimetic electrode is provided to overcome the above-said shortcoming in the prior arts.

The electrode comprises hydrophobic silica microspheres and hydrophilic nano catalysts.

The silica microspheres have diameters in a range of 0.9 to 1.2 μm; the nano catalysts have sizes in a range of 40 to 60 nm; and the silica microspheres and the nano catalysts are configured to form a periodic structure with raised portions and interspersed grooves.

In a preferred embodiment of the rose petal effect-based biomimetic electrode according to the present invention, the electrode has a surface exhibiting a microscopically alternating hydrophilic-hydrophobic periodic structure.

In a preferred embodiment of the rose petal effect-based biomimetic electrode according to the present invention, no bubbles are generated on the surface of the electrode when the electrode is used for electrolysis of water.

According to another aspect of the present invention, a method for fabricating the rose petal effect-based biomimetic electrode is provided. The method comprises:

- sonicating carbon nanotubes in anhydrous ethanol, then sequentially adding a 5% Nafion solution, hydrophobic silica, and nano carbon powder via sonication, to obtain a first solution;
- spraying the first solution onto hydrophobic carbon paper to form a base layer;
- sonicating carbon nanotubes in anhydrous ethanol, then sequentially adding a 5% Nafion solution, hydrophobic silica, and nano platinum carbon catalysts via sonication, to obtain the second solution;
- spraying the second solution onto the base layer to form a thick catalytic layer, then sintering and cooling the thick catalytic layer to obtain the rose petal effect-based biomimetic electrode.

In a preferred embodiment of the rose petal effect-based biomimetic electrode according to the present invention, the first solution comprises 2 to 4 mg of carbon nanotubes, 10 ml of anhydrous ethanol, 18 to 22 mg of 5% Nafion solution, 140 to 160 mg of hydrophobic silica, and 12 to 18 mg of nano carbon powder; and the base layer has a thickness in a range of 40 to 60 μm.

In a preferred embodiment of the rose petal effect-based biomimetic electrode according to the present invention, the second solution comprises 2 to 4 mg of carbon nanotubes, 10 ml of anhydrous ethanol, 18 to 22 mg of 5% Nafion solution, 30 to 50 mg of hydrophobic silica, 5 to 7 mg of nano carbon powder; and the thick catalytic layer has a thickness in a range of 10 to 12 μm.

In a preferred embodiment of the rose petal effect-based biomimetic electrode according to the present invention, the sintering is performed at a temperature of 135° C. for a duration of 0.5 hour.

According to a further aspect of the present invention, a membrane-less water electrolysis reactor utilizing the rose petal effect-based biomimetic electrode is provided to overcome the above-said shortcoming in the prior arts.

The reactor comprises a PMMA chamber plate, a cathode and an anode. The cathode and anode are disposed on two opposite exterior side walls (e.g., the top and bottom side walls) of the PMMA chamber plate. The thickness of the PMMA chamber plate is equal to the distance between the cathode and anode The reactor comprises a PMMA chamber plate, a cathode and an anode. The cathode and anode are disposed on two opposite exterior side walls of the PMMA chamber plate.

The reactor further comprises a cathode assembly. The cathode assembly includes one or more conduits communicable with the PMMA chamber plate and a cathode titanium current collector plate. The cathode assembly further includes a cathode gas passage integrally formed outside of the cathode titanium current collector plate. The cathode assembly further includes a cathode fluorine rubber gasket configured to seal between the cathode titanium current collector plate and the PMMA chamber plate.

The reactor further comprises an anode assembly. The anode assembly includes an anode titanium current collector plate and an anode fluorine rubber gasket configured to seal between the anode titanium current collector plate and the PMMA chamber plate. The anode assembly further includes an anode gas passage integrally formed outside of the anode titanium current collector plate.

Both the cathode and the anode are made of biomimetic electrode materials based on the rose petal effect.

In a preferred embodiment of the membrane-less water electrolysis reactor according to the present invention, the reactor further comprises a first end plate disposed outside of the cathode titanium current collector plate. The first end plate has a liquid channel communicable with the conduit and a first gas channel communicable with the cathode gas passage.

In a preferred embodiment of the membrane-less water electrolysis reactor according to the present invention, the reactor further comprises a second end plate disposed outside of the anode titanium current collector plate. The second end plate has a gas chamber communicable with the anode gas passage and a second gas channel for allowing gas to flow out from the gas chamber.

The present invention has the following beneficial effects:

The rose petal effect-based biomimetic electrode provided by the present invention can address the technical issues in existing technologies. The electrode surface features a microscale periodic structure with alternating hydrophilic and hydrophobic parts. The hydrophilic parts ensure a strong interaction and good contact between the electrode catalyst and the electrolyte solution, thereby guaranteeing the electrode's catalytic performance. The hydrophobic parts allow the gas generated at the electrode surface to be discharged through internal porous channels, preventing the formation of visible bubbles on the electrode surface and fundamentally avoiding issues caused by bubble formation.

The membrane-less water electrolysis reactor utilizing the rose petal effect-based biomimetic electrode provided by the present invention can eliminate bubble formation on the electrode surface, thereby avoiding problems related to bubble covering catalytic sites, bubble resistance, and gas mixing. Additionally, it reduces electrolyte resistance loss, making the performance of the membrane-less water electrolysis reactor approach that of membrane electrode reactors.

BRIEF DESCRIPTION OF THE DRAWINGS

To provide a clearer explanation of the technical solutions in the embodiments of the present invention, the following will briefly introduce the drawings needed for the description of the embodiments. It is apparent that the drawings described below are only some examples of the present invention. Ordinary skilled persons in this art can derive other drawings based on these drawings without exercising creative effort.

DETAILED DESCRIPTION

Figure 1A:
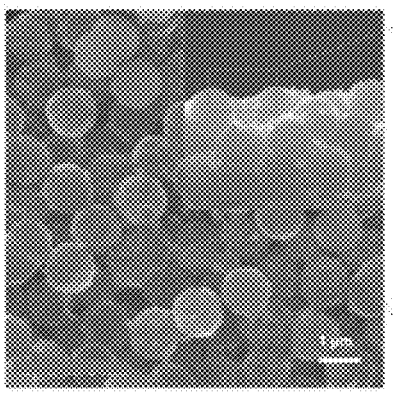
FIGS. 1A and 1B depict respectively a nano-scale scanning electron microscope image and a schematic diagram of the structure of the rose petal effect-based biomimetic electrode according to a Embodiment 1 of the present invention.

To make the above objectives, features, and advantages of the present invention more evident and understandable, detailed explanations of specific embodiments of the present invention are provided below in conjunction with the specification.

In the following description, numerous specific details are provided for fully understanding the embodiments of the present invention. However, the present invention can also be implemented utilizing other ways not described here. Those skilled in the art can make similar generalizations without departing from the essence of the present invention. Therefore, the specific embodiments disclosed below do not limit the scope of the present invention.

Furthermore, the terms "an embodiment" or "embodiments" used herein refer to specific features, structures, or characteristics that can be included in at least one implementation of the present invention. The phrase "in one embodiment" appearing in different parts of this specification does not necessarily refer to the same embodiment, and it is not meant to imply that they are mutually exclusive or selectively incompatible with other embodiments.

Embodiment 1

This embodiment provides a method for preparing a rose petal effect-based biomimetic electrode, specifically, the method comprises:

Sonicating 3 mg of carbon nanotubes in 10 ml of anhydrous ethanol to form a carbon nanotube dispersion; sequentially adding 20 mg of 5% Nafion solution, 150 mg of hydrophobic silica, and 15 mg of nano carbon powder into the carbon nanotube dispersion to form a mixture; sonicating the mixture for 1 hour to obtain a first solution.

Spraying or applying 200 μl of the first solution onto a hydrophobic carbon paper to form a 200 μm thick base layer.

Sonicating 3 mg of carbon nanotubes in 10 ml of anhydrous ethanol to form a carbon nanotube dispersion. Sequentially adding 20 mg of 5% Nafion solution, 35 mg of hydrophobic silica, and 5 mg of nano platinum carbon catalyst into the carbon nanotube dispersion to form a mixture. Sonicating the mixture for 1 hour to obtain a second solution.

Spraying or applying 100 μl of the second solution onto the base layer to form a 50 μm thick catalytic layer on the base layer to obtain a product.

Placing the product obtained from step 2) into a furnace and sintering the product at 135° C. for 0.5 hour, then cooling the product to room temperature to obtain the rose petal effect-based biomimetic electrode.

Figure 1B:
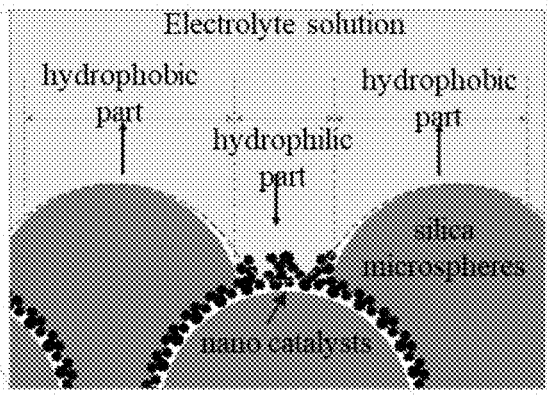

FIGS. 1A and 1B depict a nano-scale scanning electron microscope image and a schematic diagram of a structural unit of the rose petal effect-based biomimetic electrode produced in this embodiment respectively. As shown, the entire electrode surface (as shown in FIG. 1A) is deposited with the structural units (as shown in FIG. 1B), forming a biomimetic electrode exhibiting the rose petal effect. The hydrophobic silica imparts hydrophobic characteristics to the entire electrode surface. The catalyst between the hydrophobic silica is hydrophilic, ensuring good contact between the electrolyte and the catalyst. This results in an electrode surface being hydrophobic while exhibiting a relatively strong water affinity.

Figure 2A:
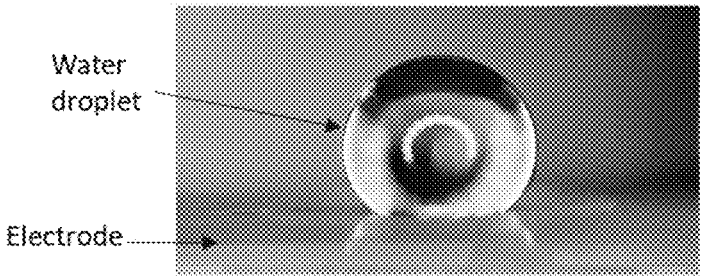
FIGS. 2A and 2B illustrate the hydrophilic and hydrophobic characteristics of the rose petal effect-based biomimetic electrode according to Embodiment 1, respectively.
Figure 2B:
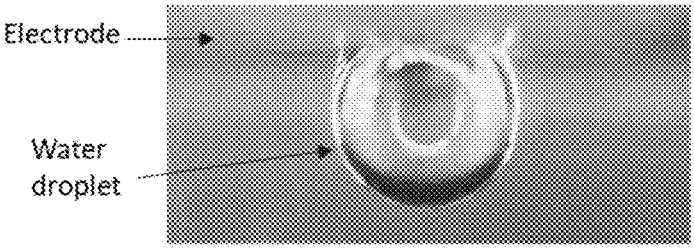

FIGS. 2A and 2B illustrate respectively the hydrophilic and hydrophobic characteristics of the electrode prepared in this embodiment. As shown in FIG. 2A, when a water droplet is placed on top of the electrode, it maintains a spherical shape and the contact angle of the water droplet is greater than 90 degrees, indicating that the electrode is hydrophilic. As shown in FIG. 2B, after the electrode is flipped upside down, the water droplet does not fall off, indicating that the electrode has strong water affinity.

Performance Evaluation of the Rose Petal Effect-Based Biomimetic Electrodes

The following groups of electrochemical tests are performed on electrode of different materials to compare the performance of the rose petal effect-based biomimetic electrode obtained in the present invention.

Figure 4:
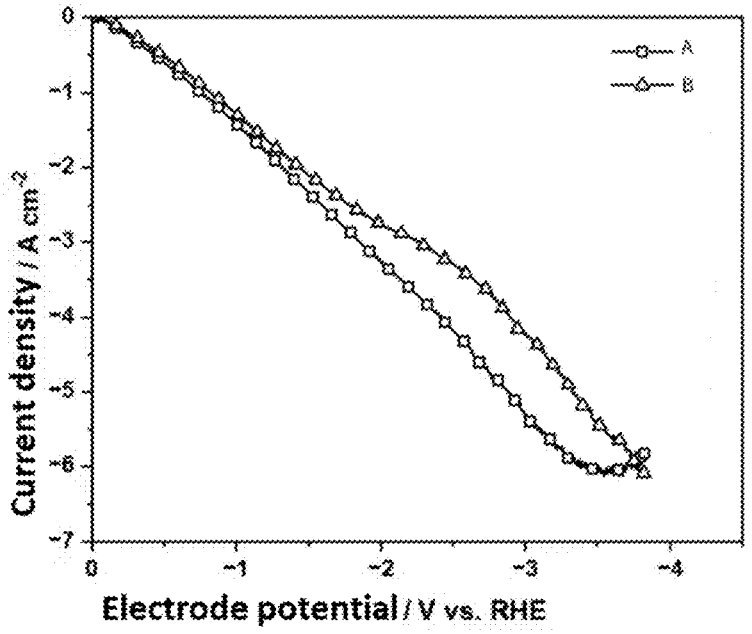
FIG. 4 shows the electrochemical performance comparison results between electrode A and electrode B in the present invention.

Group A: the performance of the rose petal effect-based biomimetic electrode and a conventional hydrophilic iridium-ruthenium metal electrode as the anode were tested in 1 mol/L sulfuric acid solution. The results are shown in FIG. 4.

In this group of tests, it can be observed that the anode surface of the conventional flat electrode was covered with a large number of bubbles during operation, while no bubble generation was observed on the cathode surface of the rose petal effect-based biomimetic electrode. The generated bubbles were directly discharged into the atmosphere through the internal channels of the electrode.

Figure 5:
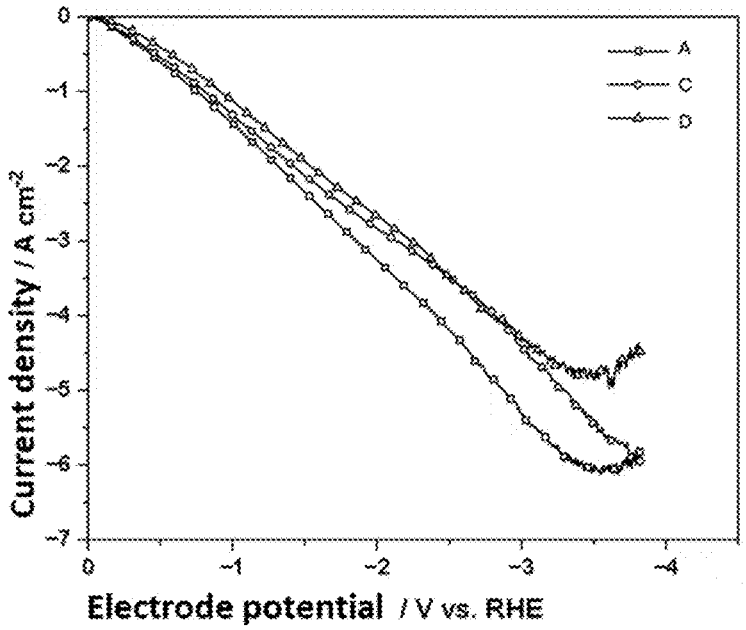
FIG. 5 displays the electrochemical performance comparison results among electrode A and electrodes C and D in the present invention under different conditions.

Group B: The performance of the rose petal effect-based biomimetic electrode, a flat platinum electrode, and a conventional porous gas diffusion electrode were tested in 1 mol/L sulfuric acid solution. The behavior of bubbles for each electrode at different current densities is shown in FIG. 5.

Figure 3:
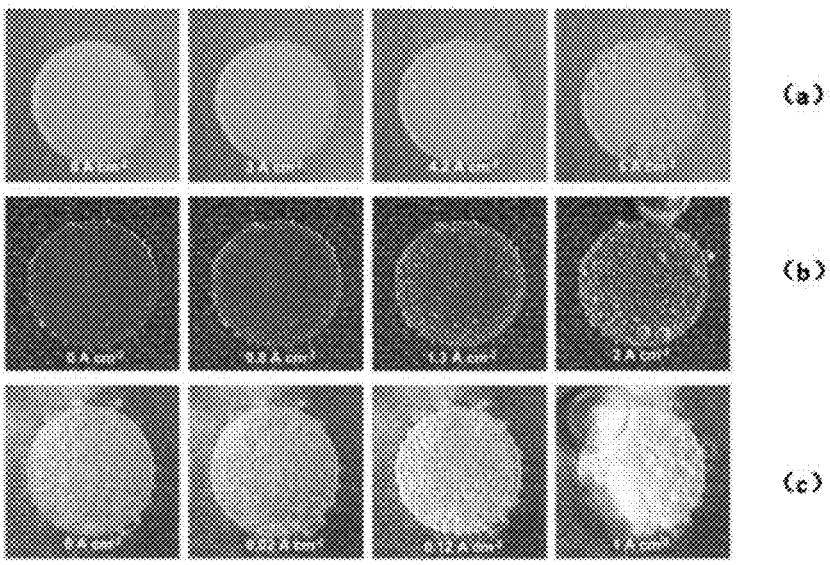
FIG. 3 show a performance comparison among the rose petal effect-based biomimetic electrode, a conventional porous gas diffusion electrode, and a planar platinum electrode.

FIG. 3 shows comparison among experimental results of a) the rose petal effect-based biomimetic electrode, b) the conventional porous gas diffusion electrode, and c) the flat platinum electrode, respectively. For the rose petal effect-based biomimetic electrode, when the current density was 2 A $cm^{-2}$, no hydrogen bubbles were observed on the cathode surface. As the current density continued to increase to 4.2 A $cm^{-2}$, bubbles began to appear on the electrode surface.

For the conventional porous gas diffusion electrode and the hydrophilic flat platinum electrode, a large number of hydrogen bubbles were already observed on the electrode surface at the current density of 0.8 A $cm^{-2}$ and 0.02 A $cm^{-2}$, respectively.

The above results demonstrate that the hydrophilic part of the rose petal effect-based biomimetic electrode ensures good contact between the catalyst and the electrolyte solution, thereby ensuring the electrode's catalytic performance. The hydrophobic part allows the gases generated on the electrode surface to be released through the internal porous channels of the electrode, avoiding the visible bubbles on the electrode surface thus fundamentally preventing problems caused by bubbles.

Comparison of Electrochemical Performance of Biomimetic Electrodes Prepared by Different Preparation Schemes Electrode A: Rose petal effect-based biomimetic electrode obtained in Embodiment 1 of the present invention.

Electrode B: Similar to Embodiment 1, with the difference being the adjustment of the dosage of silica dioxide to 15 mg in step 2, while keeping the rest of the preparation process the same as in Embodiment 1.

The comparison results between Electrode A and Electrode B are shown in FIG. 4. It can be observed that the electrode A obtained in the present invention has superior electrochemical performance compared to electrode B. Therefore, the dosage of silica dioxide was chosen as 35 mg.

Electrode C: Different from Embodiment 1, the spray amount of the first solution on hydrophobic carbon paper in step 1 was adjusted to 100 μl, while keeping the rest of the preparation process the same as in Embodiment 1.

Electrode D: Different from Embodiment 1, the spray amount of the second solution on hydrophobic carbon paper in step 1 was adjusted to 200 μl, while keeping the rest of the preparation process the same as in Embodiment 1.

The comparison results between Electrode A and Electrodes C. D are shown in FIG. 5. It can be observed that the electrode A obtained in the present invention has superior electrochemical performance compared to electrodes C and D. Therefore, the spray amounts of the first solution and second solution on hydrophobic carbon paper were chosen as 200 μl and 100 μl, respectively.

Embodiment 2

Figure 6:
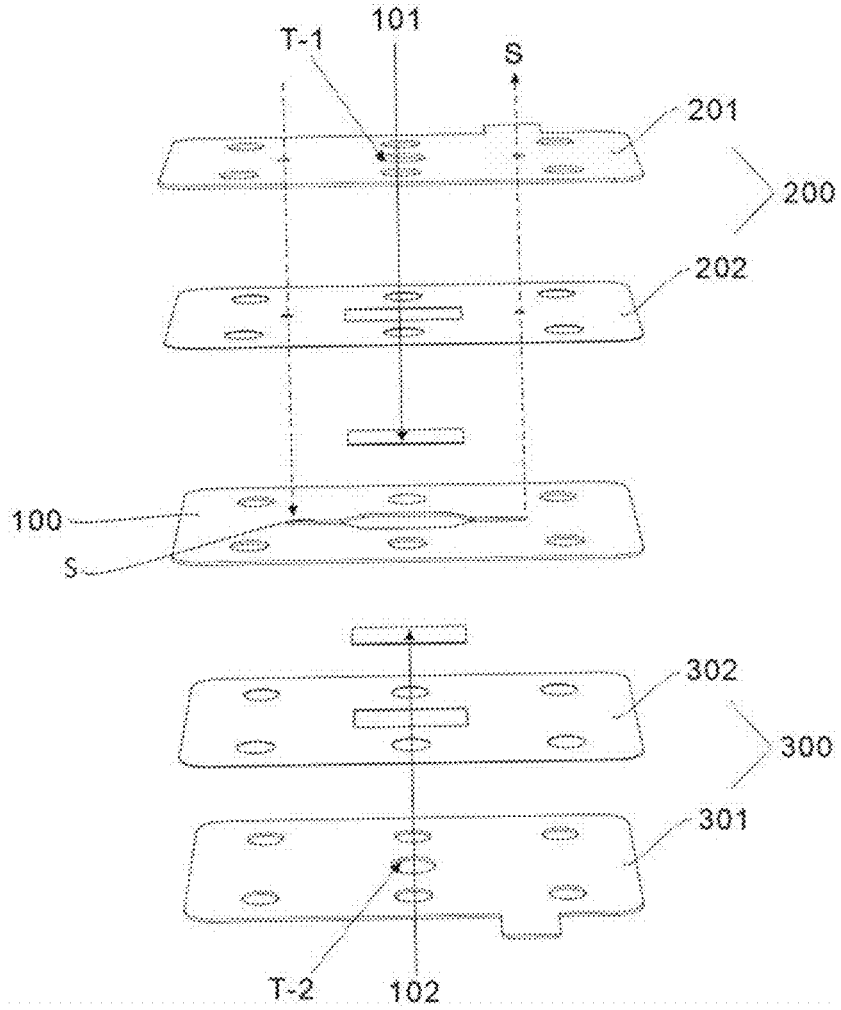
FIG. 6 is a schematic diagram of the water electrolysis reactor in Embodiment 2 of the present invention.
Figure 7:
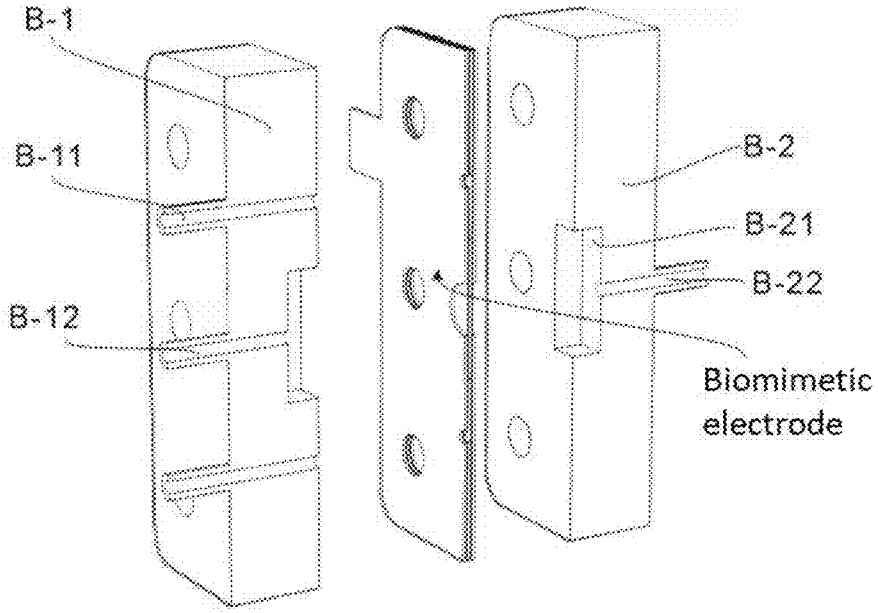
FIG. 7 presents a sectional schematic diagram of the water electrolysis reactor device in Embodiment 2 of the present invention.

As shown in FIGS. 6 and 7, this embodiment provides a membrane-less water electrolysis reactor utilizing rose petal effect-based biomimetic electrodes.

The reactor comprises a PMMA chamber plate 100, a cathode 101 and an anode 102. The cathode 101 and anode 102 are disposed on two opposite exterior side walls (e.g., the top and bottom side walls) of the PMMA chamber plate. The thickness of the PMMA chamber plate is equal to the distance between the cathode and anode.

The reactor further comprises a cathode assembly 200. The cathode assembly 200 includes one or more conduits S communicable with the PMMA chamber plate 100 and a cathode titanium current collector plate 201. The cathode assembly 200 further includes a cathode gas passage T-1 integrally formed outside of the cathode titanium current collector plate 201. The cathode assembly 200 further includes a cathode fluorine rubber gasket 202 configured to seal between the cathode titanium current collector plate 201 and the PMMA chamber plate 100.

Specifically, the reactor further comprises a first end plate B-1 disposed outside of the cathode titanium current collector plate 201. The first end plate B-1 has a liquid channel B-11 communicable with the conduit S and a first gas channel B-12 communicable with the cathode gas passage T-1.

The reactor further comprises an anode assembly 300. The anode assembly 300 includes an anode titanium current collector plate 301 and an anode fluorine rubber gasket 302 configured to seal between the anode titanium current collector plate 301 and the PMMA chamber plate 100. The anode assembly 300 further includes an anode gas passage T-2 integrally formed outside of the anode titanium current collector plate 301.

Specifically, the reactor further comprises a second end plate B-2 disposed outside of the anode titanium current collector plate 301. The second end plate B-2 has a gas chamber B-21 communicable with the anode gas passage T-2 and a second gas channel B-22 for gas flowing out from the gas chamber B-21.

Both the cathode 101 and the anode 102 are made of biomimetic electrode materials based on the rose petal effect.

More specifically, during the operation of the reactor, the electrolyte flows into the PMMA chamber plate 100 from one end of the conduit S and exits through the other end after filling the chamber plate 100. When the electrolysis of water is performed to generate hydrogen, the gases generated at the cathode and anode are discharged through the cathode gas passage T-1 and anode gas passage T-2, respectively.

It should be noted that the first end plate B-1 and the second end plate B-2 are used for installing the inlet and outlet for electrolyte and outlets for gases release from the cathode and anode.

When the reactor is assembled and secured, the fluorine rubber gaskets undergo deformation, resulting in a decrease in thickness. The chamber design area is slightly smaller than the electrode area, cautilizing the electrode edges to be pressed onto the titanium current collector plate, forming ohmic contact. The titanium current collector plate is used for power input, thereby forming an electrochemical circuit.

Actual Application Effects of the Membrane-Less Water Electrolysis Reactor

Figure 8:
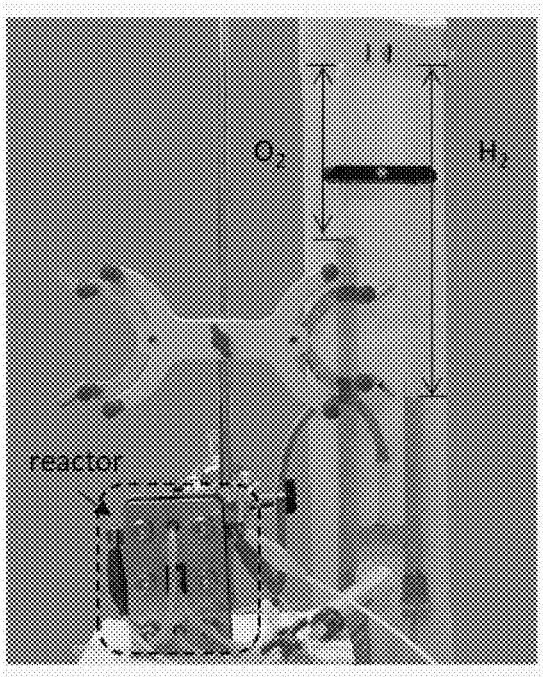
FIG. 8 is a photo showing actual operation of the water electrolysis reactor in Embodiment 2 of the present invention.

FIG. 8 shows a picture of an experimental setup for evaluating actual application effects of the membrane-less water electrolysis reactor according to one embodiment of the present invention. The outlets of the anode and cathode gas channels of the reactor are connected to a Hoffman device. By observing the cathode and anode water columns, it is found that the gas volume ratio of hydrogen to oxygen is 2:1, demonstrating that the membrane-less reactor of the present invention can effectively separate the gases released at the anode and cathode.

Figure 9A:
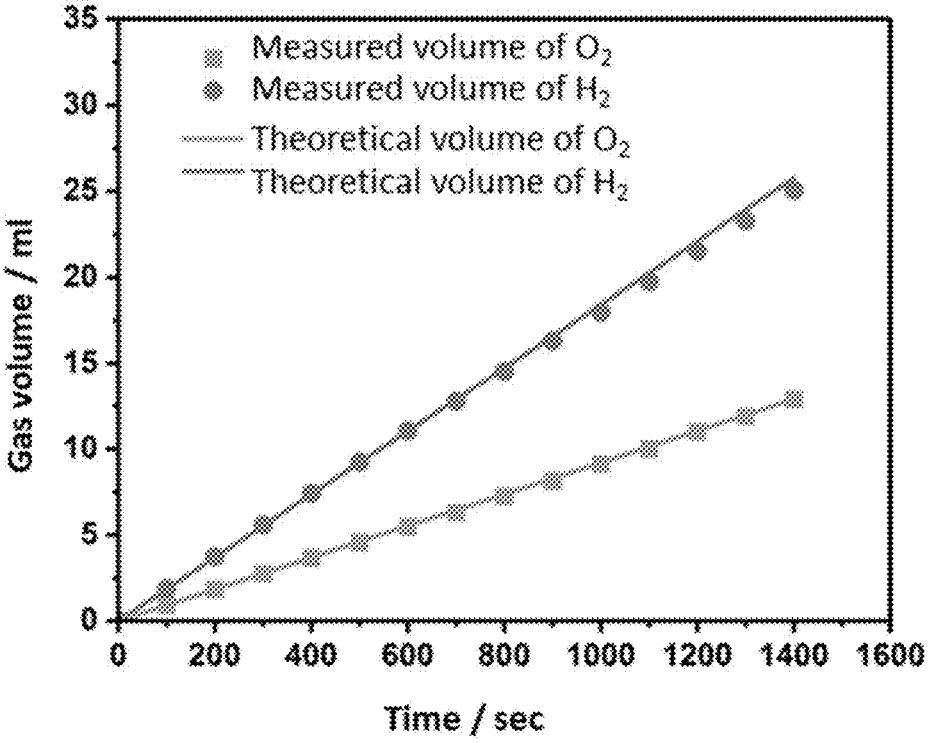
FIGS. 9A and 9B depict respectively the variation of gas production over time and the voltage variation over time at a current density of 1 A $cm^{-2}$ for the membrane-less water electrolysis reactor utilizing the rose petal effect-based biomimetic electrode in Embodiment 2 of the present invention.
Figure 9B:
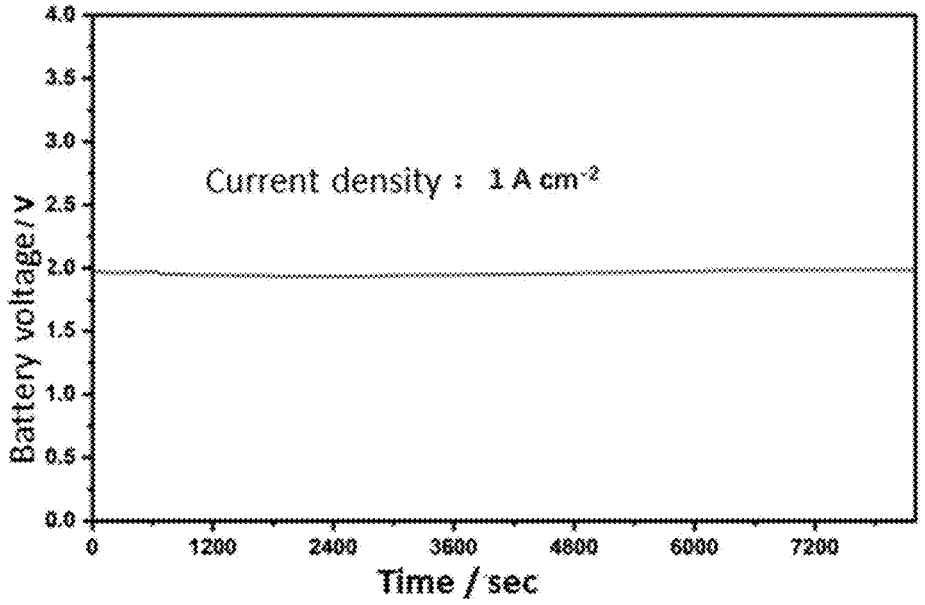

FIGS. 9A and 9B depict respectively the variation of gas production over time and the voltage variation over time at a current density of 1 A $cm^{-2}$ for the membrane-less water electrolysis reactor. From FIG. 9A, it can be deduced that the measured values of gas production at the anode and cathode match the theoretical values, indicating that the membraneless water electrolysis reactor can effectively prevent gas mixing. From FIG. 9B, it can be seen that the voltage remains relatively stable over time, indicating stable operation of the reactor.

Figure 10:
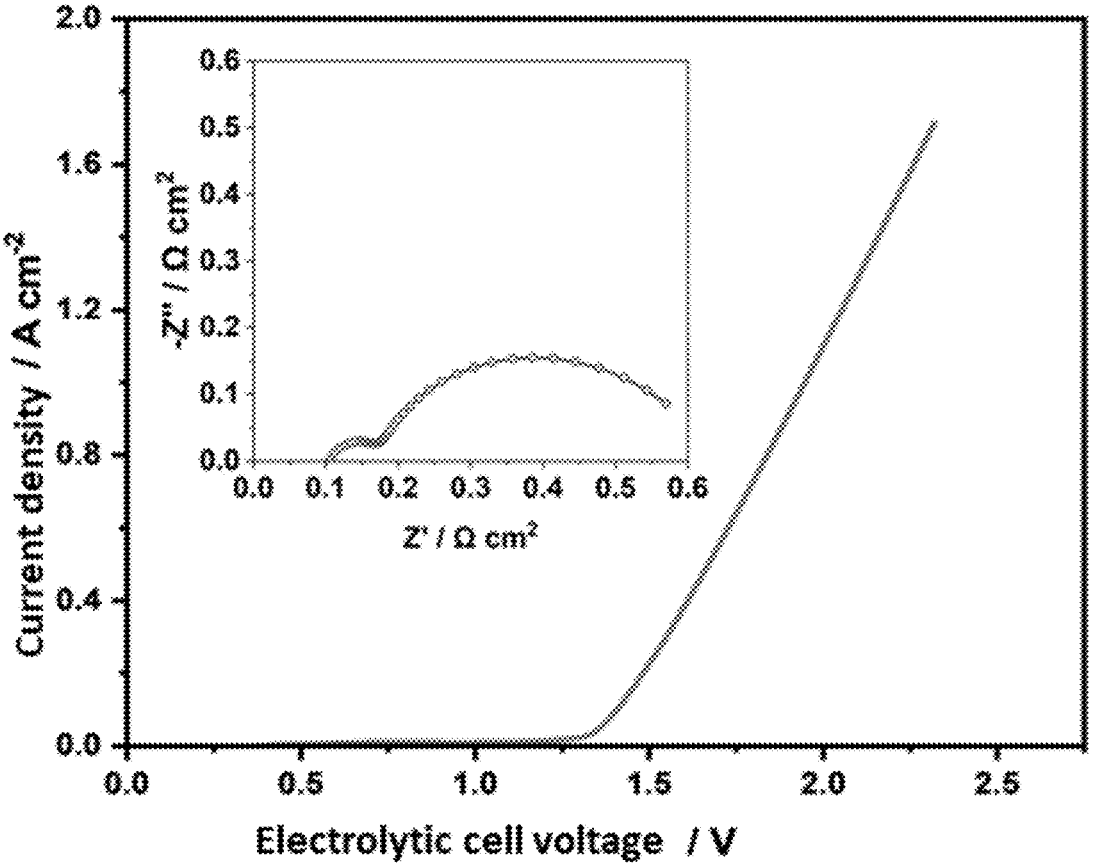
FIG. 10 illustrates the linear voltammetry and the impedance spectroscopy curves in the application of the water electrolysis reactor utilizing the rose petal effect-based biomimetic electrode in Embodiment 2 of the present invention.

FIG. 10 shows a linear voltammetry curve and the AC impedance spectrum curve (inset of FIG. 10) of the membrane-less water electrolysis reactor. The linear voltammetry curve reveals that at a current density of 1 A $cm^{-2}$, the electrolytic cell voltage is approximately 2V, corresponding to an energy conversion efficiency of about 62%. From the intersection of the AC impedance spectrum curve with the X-axis, it can be determined that the electrolytic cell internal resistance is about 0.1 $\Omega cm^2$. The performance of the membrane-less water electrolysis reactor is excellent.

Table 1 shows the gas mixing rate for different anode-cathode distances. The distance between the anode and cathode can be altered by varying the thickness of the PMMA (or organic glass) chamber.

TABLE 1

Gas mixing rate for different anode-cathode distances

| Current Densities | Distances 0.5 mm | 1.0 mm | 1.5 mm |
|---|---|---|---|
| 0.2 A $cm^{-2}$ | 0.015% | 0.012% | not detected |
| 0.5 A $cm^{-2}$ | 0.008% | 0.007% | 0.002% |
| 0.75 A $cm^{-2}$ | 0.01% | 0.013% | 0.005% |
| 1.0 A $cm^{-2}$ | 0.004% | 0.003% | 0.003% |
| 1.5 A $cm^{-2}$ | 0.004% | 0.009% | 0.008% |

From Table 1, it can be observed that at different anode-cathode distances, the hydrogen gas mixing rate is all less than 0.02%, corresponding to gas purity greater than 99.98%. This further validates that the membrane-less water electrolysis device of this invention can effectively prevent product mixing.

In summary, the rose petal effect-based biomimetic electrode provided by the present invention can address the issues in existing technology. The electrode surface features a microscale periodic structure with alternating hydrophilic and hydrophobic parts. The hydrophilic parts ensure a strong interaction between the electrode catalyst and the electrolyte solution, thereby guaranteeing the electrode's catalytic performance. The hydrophobic parts allow the gas generated at the electrode surface to be discharged through internal porous channels, preventing the formation of visible bubbles on the electrode surface and fundamentally avoiding issues caused by bubble formation.

The membrane-less water electrolysis reactor utilizing the rose petal effect-based biomimetic electrode provided by the present invention can eliminate bubble formation on the electrode surface, thereby avoiding problems related to bubble covering catalytic sites, bubble resistance, and gas mixing. Additionally, it reduces electrolyte resistance loss, making the performance of the membrane-less water electrolysis reactor approach that of membrane electrode reactors.

The foregoing description of the present invention has been provided for the purposes of illustration and description. It is not intended to be exhaustive or to limit the invention to the precise forms disclosed. While the exemplary embodiments have been detailed in reference, those skilled in the art should understand that modifications or equivalent substitutions can be made to the technical solution provided by the present invention without departing from its spirit and scope. All such modifications or substitutions should fall within the scope of the claims of this invention.

What is claimed is:

1. A rose petal effect-based biomimetic electrode, characterized in that the electrode comprises hydrophobic silica microspheres and hydrophilic nano catalysts; and wherein, the silica microspheres have diameters in a range of 0.9 to 1.2 μm; the nano catalysts have sizes in a range of 40 to 60 nm; and the silica microspheres and the nano catalysts are configured to form a periodic structure with raised portions and interspersed grooves.

2. The rose petal effect-based biomimetic electrode according to claim 1, characterized in that: the electrode has a surface exhibiting a microscopically alternating hydrophilic-hydrophobic periodic structure.

3. The rose petal effect-based biomimetic electrode according to claim 1, characterized in that: no bubbles are generated on the surface of the electrode when the electrode is used for electrolysis of water.

4. A method for fabricating the rose petal effect-based biomimetic electrode of claim 1, comprising:

sonicating carbon nanotubes in anhydrous ethanol, then sequentially adding a 5% Nafion solution, hydrophobic silica, and nano carbon powder by sonication, to obtain a first solution;

spraying the first solution onto hydrophobic carbon paper to form a base layer;

sonicating carbon nanotubes in anhydrous ethanol, then sequentially adding a 5% Nafion solution, hydrophobic silica, and nano platinum carbon catalysts via sonication, to obtain the second solution; and spraying the second solution onto the base layer to form a thick catalytic layer, then sintering and cooling the thick catalytic layer to obtain the rose petal effect-based biomimetic electrode.

5. The method according to claim 4, characterized in that: the first solution comprises 2 to 4 mg of carbon nanotubes, 10 ml of anhydrous ethanol, 18 to 22 mg of 5% Nafion solution, 140 to 160 mg of hydrophobic silica, and 12 to 18 mg of nano carbon powder; and the base layer has a thickness in a range of 40 to 60 μm.

6. The method according to claim 4, characterized in that: the second solution comprises 2 to 4 mg of carbon nanotubes, 10 ml of anhydrous ethanol, 18 to 22 mg of 5% Nafion solution, 30 to 50 mg of hydrophobic silica, 5 to 7 mg of nano carbon powder; and the thick catalytic layer has a thickness in a range of 10 to 12 μm.

7. The method according to claim 4, characterized in that: the sintering is performed at a temperature of 135° C. for a duration of 0.5 hour.

8. A membrane-less water electrolysis reactor utilizing the rose petal effect-based biomimetic electrode of claim 1, characterized in comprising:

a PMMA chamber plate;

a cathode and an anode, disposed on two opposite exterior side walls of the PMMA chamber plate respectively;

a cathode assembly, including: one or more conduits communicable with the PMMA chamber plate; a cathode titanium current collector plate; a cathode gas passage integrally formed outside of the cathode titanium current collector plate; and a cathode fluorine rubber gasket configured to seal between the cathode titanium current collector plate and the PMMA chamber plate;

an anode assembly, including: an anode titanium current collector plate; an anode fluorine rubber gasket configured to seal between the anode titanium current collector plate and the PMMA chamber plate; and an anode gas passage integrally formed outside of the anode titanium current collector plate;

wherein the cathode and the anode are made of the rose petal effect-based biomimetic electrode.

9. The membrane-less water electrolysis reactor according to claim 8, characterized in further comprising a first end plate disposed outside of the cathode titanium current collector plate; and first end plate has a liquid channel communicable with the conduit and a first gas channel communicable with the cathode gas passage.

10. The membrane-less water electrolysis reactor according to claim 8, characterized in further comprising a second end plate disposed outside of the anode titanium current collector plate; and the second end plate has a gas chamber communicable with the anode gas passage and a second gas channel for allowing gas to flow out from the gas chamber.

11. The membrane-less water electrolysis reactor according to claim 8, characterized in that: the electrode has a surface exhibiting a microscopically alternating hydrophilic-hydrophobic periodic structure.

12. The membrane-less water electrolysis reactor according to claim 8, characterized in that: no bubbles are generated on the surface of the electrode when the electrode is used for electrolysis of water.

* * * * *